United States Patent [19]

Heap

[11] Patent Number: 4,797,002

[45] Date of Patent: Jan. 10, 1989

[54] APPARATUS FOR MIXING ASPHALT COMPOSITIONS

[75] Inventor: Ronald E. Heap, Kansas City, Mo.

[73] Assignee: Standard Havens, Inc., Kansas City, Mo.

[21] Appl. No.: 877,120

[22] Filed: Jun. 23, 1986

[51] Int. Cl.[4] ..... B28C 5/46

[52] U.S. Cl. ..... 366/25; 366/228

[58] Field of Search ..... 366/2, 5, 7, 14, 22–25, 366/40, 220, 225–227, 144; 432/103, 106, 13; 106/280–283

[56] References Cited

U.S. PATENT DOCUMENTS

| | | | |
|---|---|---|---|
| 3,674,242 | 7/1972 | Stewart | 366/25 |
| 4,039,171 | 8/1977 | Shearer | 366/25 |
| 4,165,184 | 8/1979 | Schlarmann | 366/228 |
| 4,585,354 | 4/1986 | Thesenfitz | 366/25 |
| 4,600,379 | 7/1986 | Elliott | 432/106 X |

*Primary Examiner*—Timothy F. Simone

*Attorney, Agent, or Firm*—Kokjer, Kircher, Bradley, Wharton, Bowman & Johnson

[57] ABSTRACT

A drum mixer asphalt plant is provided with a rotatable cylinder having an internal passageway where the aggregates and asphalt are mixed to produce an asphaltic composition. In a first zone within the mixer, aggregates are heated and dried by heat radiation and the stream of hot gases produced by a burner flame. In a second zone within the mixer, liquid asphalt is mixed with the aggregates. An exhaust tube is disposed within the passageway and extends from the output end of the drum mixer into the first zone to remove the hot gases to prevent degradation of the asphalt. Thus, the second zone wherein the liquid asphalt is mixed with the aggregate is isolated from the hot gases used for heating and drying. Recycle asphalt material may be added in both the first and second zones of the mixer drum.

8 Claims, 5 Drawing Sheets

10
12
14
16
20
22
24
28
30
34
35
36
38
40
42
44
46
48
50
51
52
54
56
60
72
78
80
98
100
104
106
114
118
129a
11.
12.

34
35
36
38
40
46
50
58
66
68
82
87
98
100
104
106
110
114
4.
5.
6.
9.

APPARATUS FOR MIXING ASPHALT COMPOSITIONS

BACKGROUND OF THE INVENTION

This invention relates to a drum mixer asphalt plant used to produce a variety of asphalt compositions. More specifically, this invention relates to a drum mixer in which recycle material may be introduced at one or more feed locations and in which the region for the introduction of liquid asphalt and mineral fines is isolated from hot combustion gases used to dry and heat the aggregate material.

Several techniques and numerous equipment arrangements for the preparation of asphaltic cement, also referred by the trade as "hotmix" or "HMA", are known in the prior art. Particularly relevant to the present invention is the production of asphalt compositions in a drum mixer asphalt plant. Typically, water-laden virgin aggregates are heated and dried within a rotating, open-ended drum mixer through radiant, convective and conductive heat transfer from a stream of hot gases produced by a burner flame. As the aggregate material flows through the drum mixer, it is combined with liquid asphalt and mineral binder or "fines" to produce an asphalt composition.

Exposing the liquid asphalt to excessive temperatures within the drum mixer or in close proximity with the burner flame causes serious product degradation, in addition to health and safety hazards. As a result, various attempts have been proposed to help minimize combustion of the liquid asphalt necessary in the process.

Paddles or flighting mounted on the interior of the mixer have also been used to shield the liquid asphalt from the burner flame by creating a curtain of falling aggregate material disposed between the burner flame and the asphalt. While the flighting reduces the likelihood of combustion of the asphalt, the stream of hot gases emitted by the burner flame may still heat the asphalt to an excessive temperature. In such event, the more volatile components of the asphalt are released and the final product may become unfit for use in paving operations.

Excessive heating of asphalt compositions also results in a substantial air pollution control problem, known as "blue-smoke", caused when hydrocarbon constituents of asphalt are driven off and released into the atmosphere. Significant investments and efforts have been made by the industry in attempting to control blue-smoke emissions.

The use of cut-back asphalts containing diesel fuel in conventional drum mixers to produce cold-mix asphaltic cement also creates a considerable problem in that these asphalts are flammable, creating( the possibility of fires and potential explosions within the mixer when the asphalt is exposed to the burner flame or the excessive temperature of the gas stream.

Improvement is also needed in those drum mixers which recycle asphaltic cement removed from road surfaces. In these mixers, the recycle material is ground to a suitable size and mixed with the virgin aggregate prior to mixing with the asphalt. The presence of asphalt in the recycle material necessitates shielding the recycle material from the flame as well as the hot gas stream when the stream contains excessive temperatures.

The need remains in the asphalt industry for improved drum mixer design and operating techniques to address the problems and drawbacks heretofore experienced. The primary objective of this invention is to meet this need.

SUMMARY OF THE INVENTION

More specifically, an object of the invention is to provide a drum mixer which effectively isolates liquid asphalt from the radiant heat flux of a burner flame and a stream of hot gases produced therefrom.

Another object of this invention is to provide a drum mixer which may be used with recycle material and which effectively isolates the recycle material from the burner flame and hot gases.

A further object of this invention is to provide a drum mixer of the type described which reduces the amount of hydrocarbons released to the environment.

It is a still further object of this invention to provide a mixer of the type described which allows cut-back asphalts to be used to produce cold-mix asphaltic cement.

Other and further objects of the invention, together with the features of novelty appurtenant thereto, will appear in the description of the drawings.

In summary, a drum mixer is provided with a rotatable cylinder having an internal passageway where the aggregates and asphalt are mixed to produce an asphaltic cement. The passageway has a first region near an input end where the aggregates are heated and dried by heat radiation and the stream of hot gases produced by a burner flame. Located toward an output end of the passageway is a second region where the asphalt is then mixed with the aggregates. An exhaust tube is disposed within the passageway and extends from the output end of the passageway through the second region to segregate the hot gases from the asphalt to prevent degradation of the asphalt. The hot gases are drawn through the exhaust tube and the asphalt and aggregates are mixed in the passageway in an annular region between the tube and the cylinder. An opening is also provided in the cylinder for introducing recycled asphalt material into the passageway in the second region. The recycle material is isolated in the second region from the burner flame and the hot gases which would cause degradation of the asphalt contained in the recycle material.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
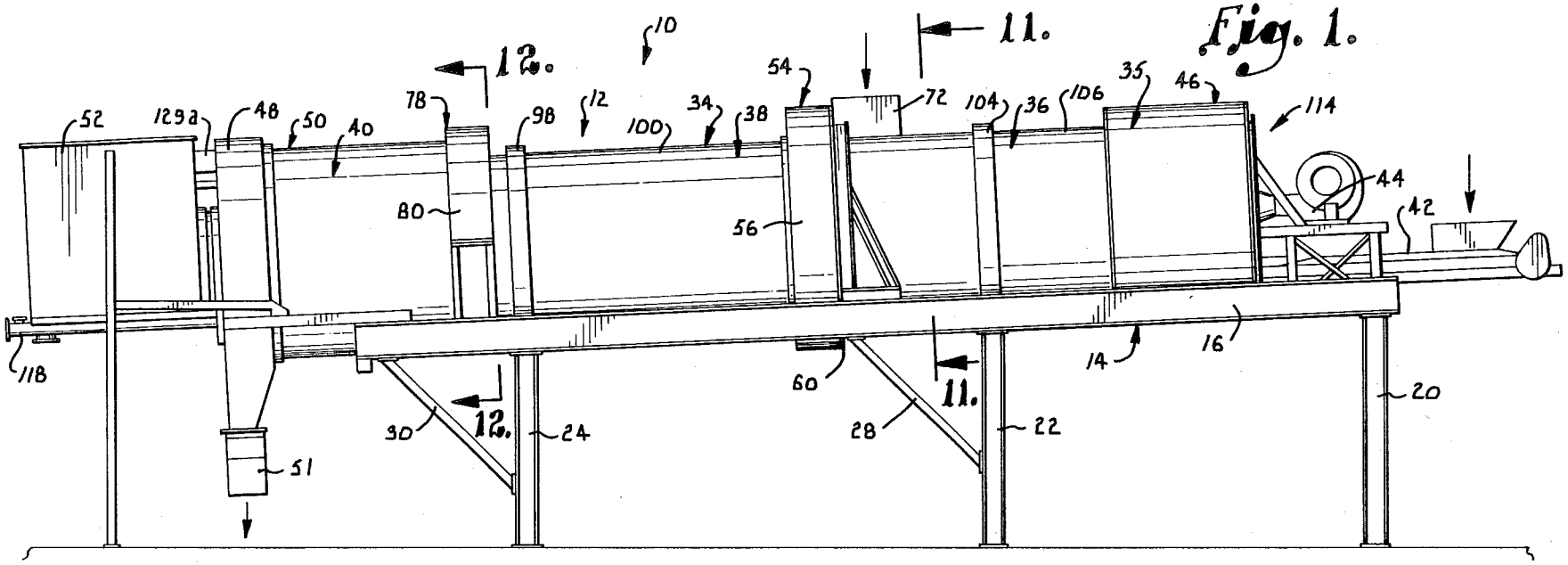
FIG. 1 is a side elevational view of an asphalt plant drum mixer constructed in accordance with a preferred embodiment of the invention, and shown connected to the aggregate feed conveyor, burner assembly and exhaust gas ductwork.

Referring now to the drawings in greater detail, the asphalt equipment of the invention is designated generally by the numeral 10 and comprises a drum mixer 12 supported on a framework 14. The framework 14 comprises parallel beams 16 and 18 inclined from a horizontal orientation and supported by vertical beams 20, 22, 24, and 26. Brace members 27, 28, 30 & 31 and cross beams 32 & 33 provide added stability for the support frame.

The drum mixer 12 comprises a rotatable cylinder 34 having drum portions 35, 36, 38 and 40, a conveyor 42 and a burner 44 located at an inlet portion 46 of the mixer 12, and a discharge housing 48 coupled with drum portion 40 at an outlet portion 50 of the mixer. The discharge housing 48 has a downwardly projecting discharge chute 51. Also located at the outlet portion 50 and coupled with the discharge housing 48 is a dust dropout chamber 52 which includes internal baffles 53.

A collar portion 54 is located between drum portions 36 and 38 and comprises rotatable outer and inner shells 56 and 58 coupled with drum portions 36 and 38, a fixed disk-shaped plate 60 supported on beams 16 and 18, and recycle inlet mechanism 62. A plurality of L-shaped plates 64 are coupled with the outer shell 56 and a plurality of openings 66 are provided in the inner shell 58. Baffles 68 and 70 are coupled with the outer and inner surfaces, respectively, of the inner shell 58. The recycle inlet mechanism 62 comprises a hopper 72, a regulating arm 74 and a discharge chute 76 having an opening 77 disposed toward the outlet portion 50 of the cylinder 34.

Another collar portion 78 is located between drum portions 38 and 40. The collar portion 78 comprises a fixed outer shell 80 supported on beams 16 and 18, a recycle inlet hopper 81 coupled with the outer shell 80, a plurality of scoops 82 coupled with drum portion 40, and a disk-shaped plate 84 coupled with an inner surface 86 of drum portion 38. Openings 87 are provided through the drum portion 40 adjacent to the scoops 82. Spiral flighting 88 and 89 is coupled with an inner surface 90 of drum portion 40 and the inner surface 86 of drum portion 38, respectively. A plurality of openings 92 are provided in plate 84.

The cylinder 12 is supported on and rotated by motor driven rollers 94 and 96 mounted on the cross-beam 32. The rollers 94 and 96 engage a raised guide 98 which is coupled with and spaced from an outer surface 100 of drum portion 38 by spacers 102. An identical set of rollers (not shown) are mounted on a cross-beam (not shown) and engage another raised guide 104 coupled with an outer surface 106 of the drum portion 36. The mixer 12 follows the inclined orientation of the supporting framework beams 16 and 18 such that a central axis along the length of the cylinder 34 inclines downwardly from the inlet portion 46 of the mixer to the outlet portion 50.

The drum mixer 12 includes a coaxial exhaust tube 108 having a downstream end 110 and an upstream end 112 which is flared radially outward. The exhaust tube 108 is positioned within a passageway 114 extending the length of the cylinder 34 with the downstream end 110 extending into the dropout chamber 52 and the upstream end 112 extending into the collar portion 78. The exhaust tube 108 is of a diameter in the order of magnitude of approximately one-half the diameter of the drum portion 40, creating an annular region 116 between the exhaust tube 108 and the inner surface 90 of the drum portion 40. A screw-type conveyor 118 is coupled with the bottom portion of the dropout chamber 52 and extends through the discharge housing 48 and into the annular region 116. The conveyor 118 has an opening 120 at an upstream end 122 located near the collar portion 78. Positioned alongside the conveyor 118 in the annular region 116 is an asphalt injection tube 124. An upstream end 126 of the tube 124 has an opening 128 for injecting asphalt into the annular region 116. An auxiliary duct **129*a* having an internal damper 129*b* also connects the discharge housing 48 with the dropout chamber 52**.

Figure 2:
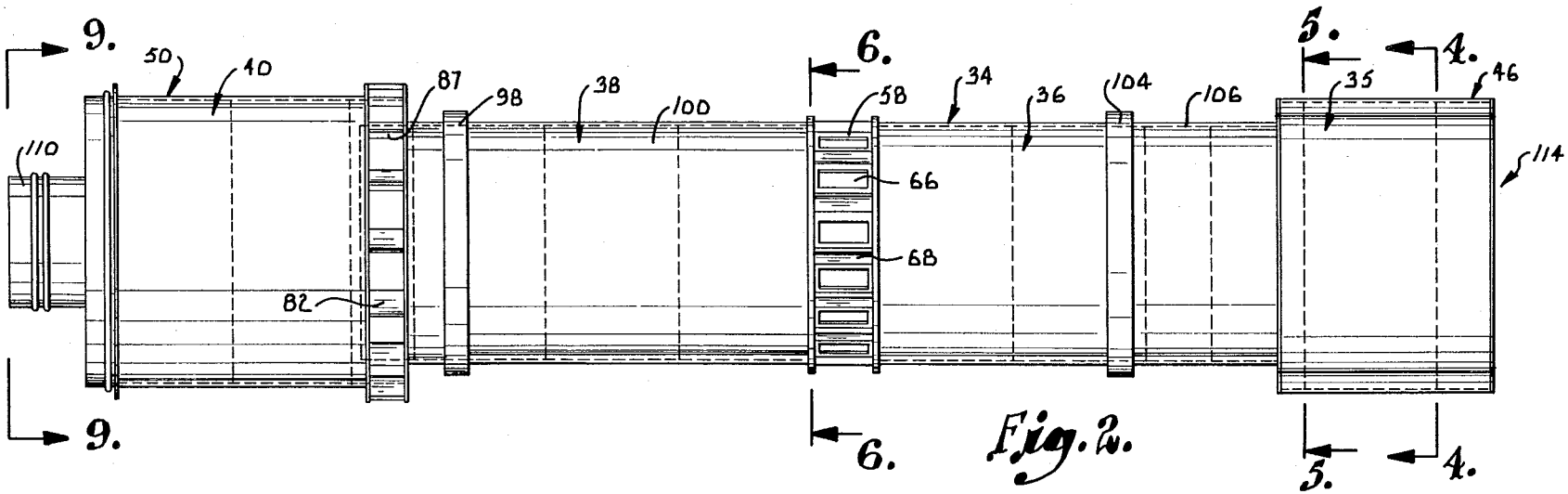
FIG. 2 is a top plan view of the drum mixer with interior zones of interest shown in broken lines.
Figure 4:
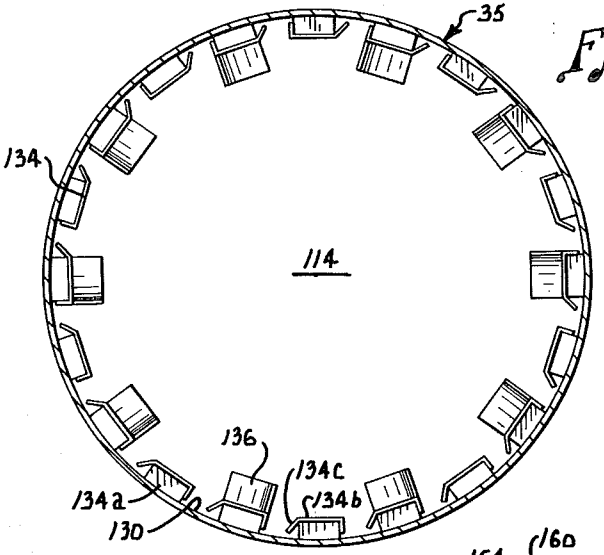
FIG. 4 is an enlarged elevational view taken along line 4—4 of FIG. 2 in the direction of the arrows to illustrate the details of the drum internal construction for the associated material handling zone.
Figure 3:
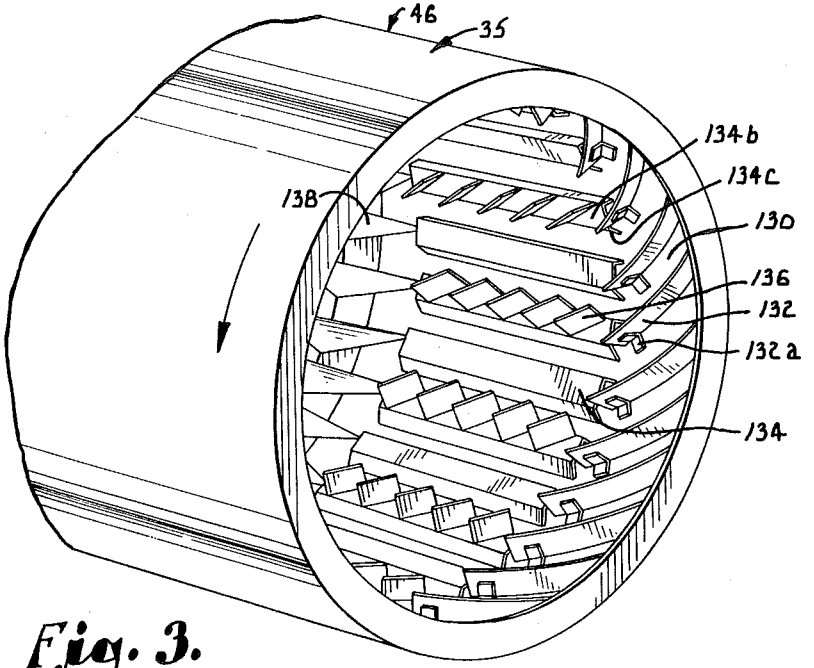
FIG. 3 is a perspective end view of the input end of the drum mixer.
Figure 6:
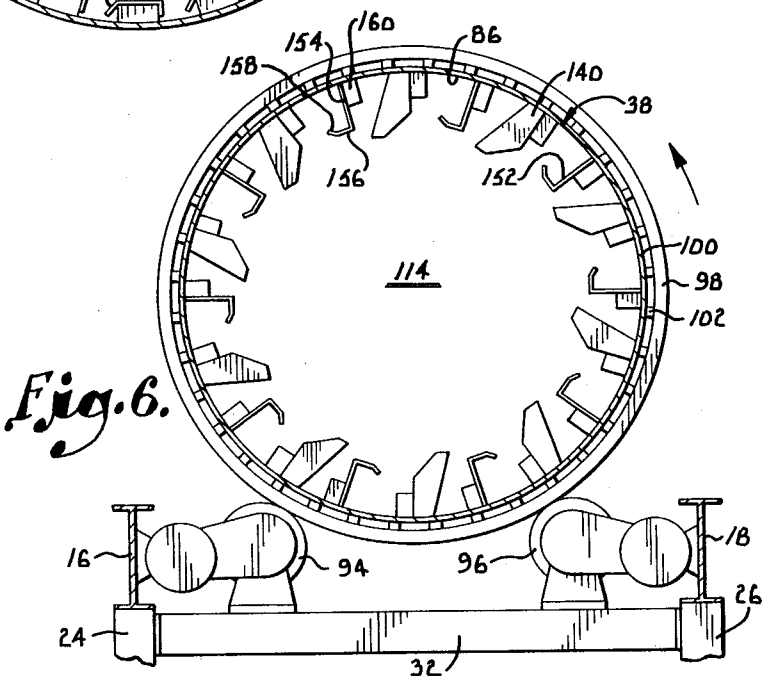
FIG. 6 is an enlarged elevational view taken along line 6—6 of FIG. 2 in the direction of the arrows to illustrate the details of the drum internal construction for the associated material handling zone and to illustrate the drive mechanism for rotation of the drum mixer.
Figure 5:
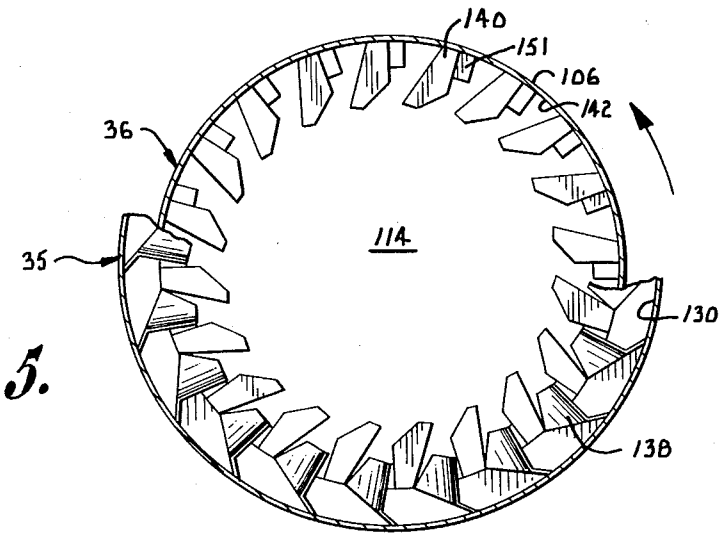
FIG. 5 is an enlarged elevational view taken along line 5—5 of FIG. 2 in the direction of the arrows to illustrate the details of the drum internal construction for the associated material handling zone.
Figure 9:
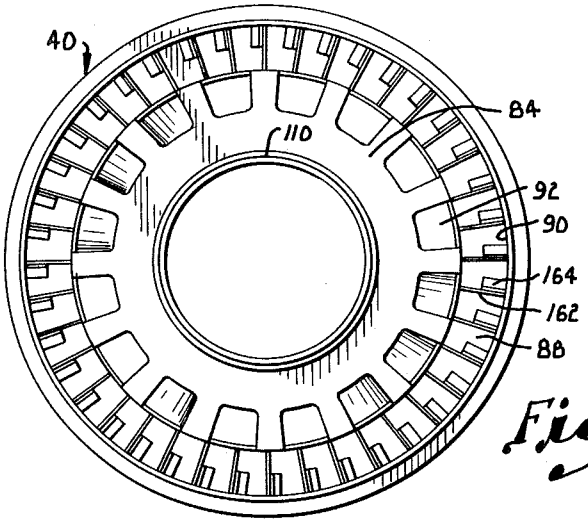
FIG. 9 is an enlarged elevational view taken along line 9—9 of FIG. 2 in the direction of the arrows to illustrate the details of the drum internal construction for the associated material handling zone at the exhaust end of the drum mixer.
Figure 10:
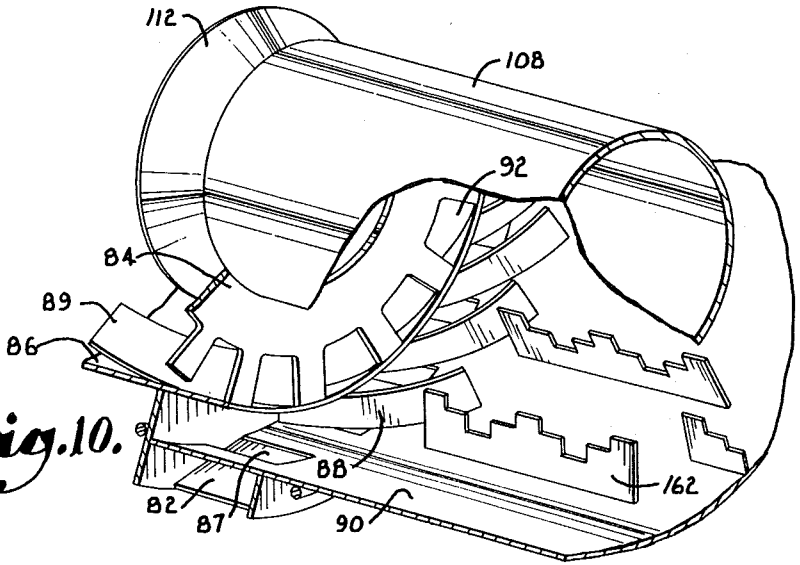
FIG. 10 is a fragmentary, perspective view to illustrate the material handling zone wherein aggregate feed is isolated from the exhaust gases and delivered to a region where liquid asphalt and mineral fines are introduced.

The drum portions 35, 36, 38 and 40 contain rows of rigid paddles or flighting coupled with interior surfaces of the drum portions along the length of the passageway 114 for moving and mixing the material within the passageway. The flighting coupled with an inner surface 130 of the drum portion 35 includes rows of spiral flighting 132 (see FIG. 4), low-profile T-flighting 134 having kicker plates 136 coupled with alternating rows of the flighting 134, and kicker flighting 138. The spiral flighting 132 comprises rigid rectangular paddles, or plates mounted on edge to the inner surface 130 by brackets **132*a*. The T-flighting 134 is mounted to the inner surface 130 by brackets 134*a* and comprise L-shaped plates 134*b* having an outwardly and downwardly projecting flange 134*c*. The plates 134*b* are mounted with the cavity formed by the shape of the plate facing the inner surface 130, and with the length of the plate extending along the passageway 114. The kicker plates 136 are mounted upright and oriented at an angle to the length of the T-flighting 134. The kicker flighting 138 is mounted at an angle such that it extends from drum portion 35 to the lip of the smaller diameter drum portion 36. The kicker flighting 138 is located at the downstream end of drum portion 35, the spiral flighting is located at the upstream end, and the T-flighting 134 is located intermediate the kicker and spiral flighting. The boundaries between the sections of flighting are indicated by broken lines in FIG. 2**.

Figure 7:
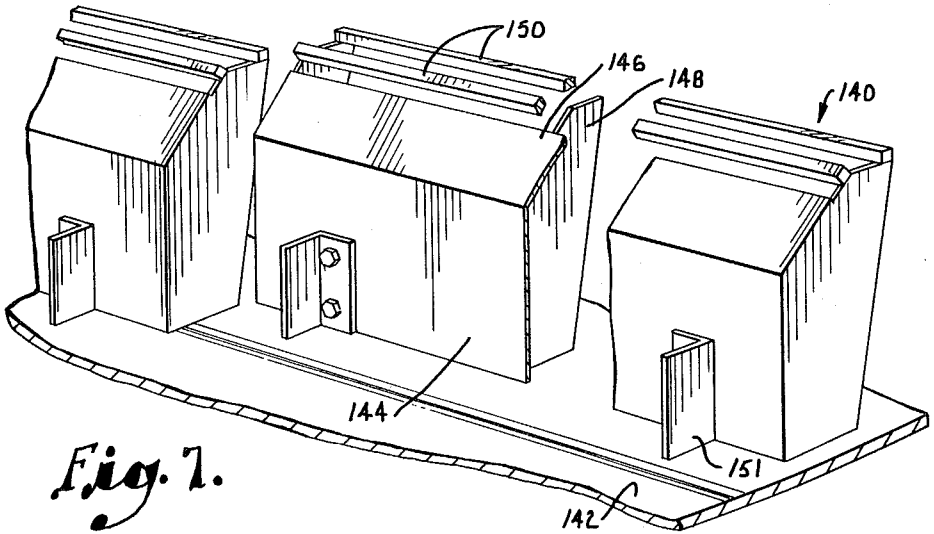
FIG. 7 is a perspective view of bucket flighting used for material handling within the drum mixer, with a portion broken away to better illustrate the construction of the flighting.

The drum portion 36 contains rows of upright bucket flighting 140 coupled with an inner surface 142 between the collar portion 54 and drum portion 35. The flighting 140 (FIG. 7) comprises an upwardly projecting plate 144 which have an upwardly and outwardly projecting portion 146, plates 148 oriented perpendicular to and coupled with plate 144, and bars 150 coupled with plates 148. The flighting 140 is mounted to surface 142 by brackets 151 and is arranged in sections having offset rows as indicated by the broken lines in FIG. 2.

Figure 8:
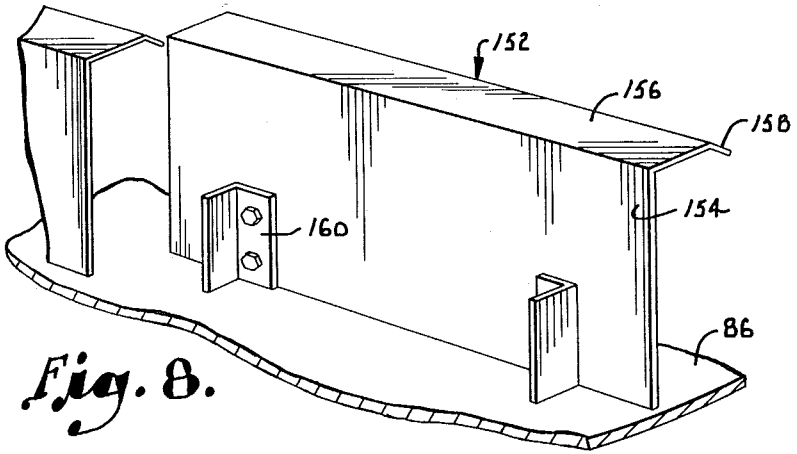
FIG. 8 is a perspective view of J-flighting used for material handling within the drum mixer.
Figure 12:
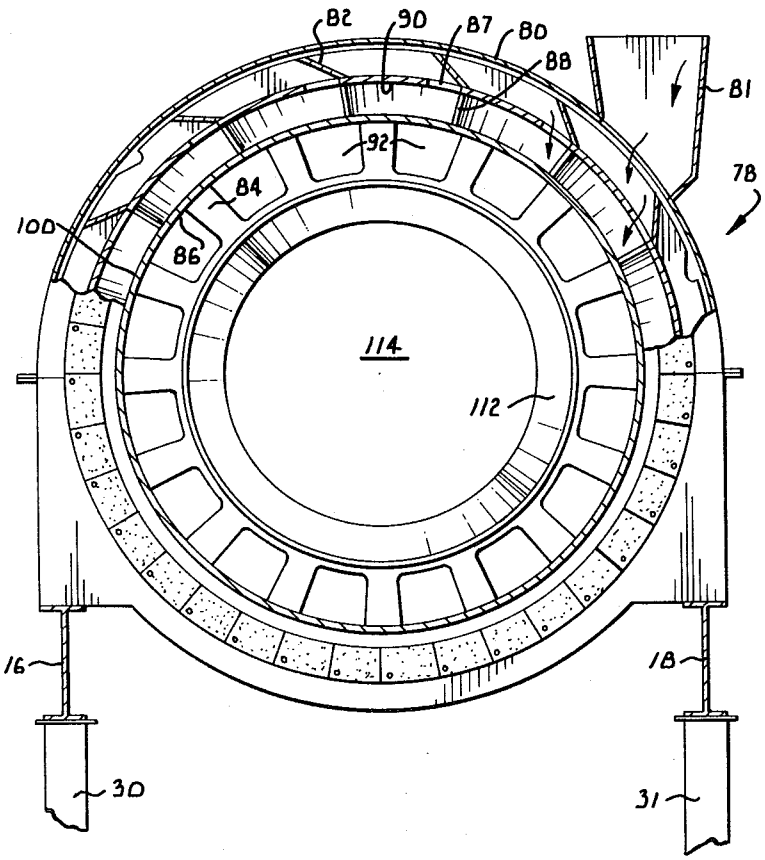
FIG. 12 is an enlarged elevational view taken along line 12—12 of FIG. 1 in the direction of the arrows to illustrate the second recycle feed zone of the drum mixer.
Figure 11:
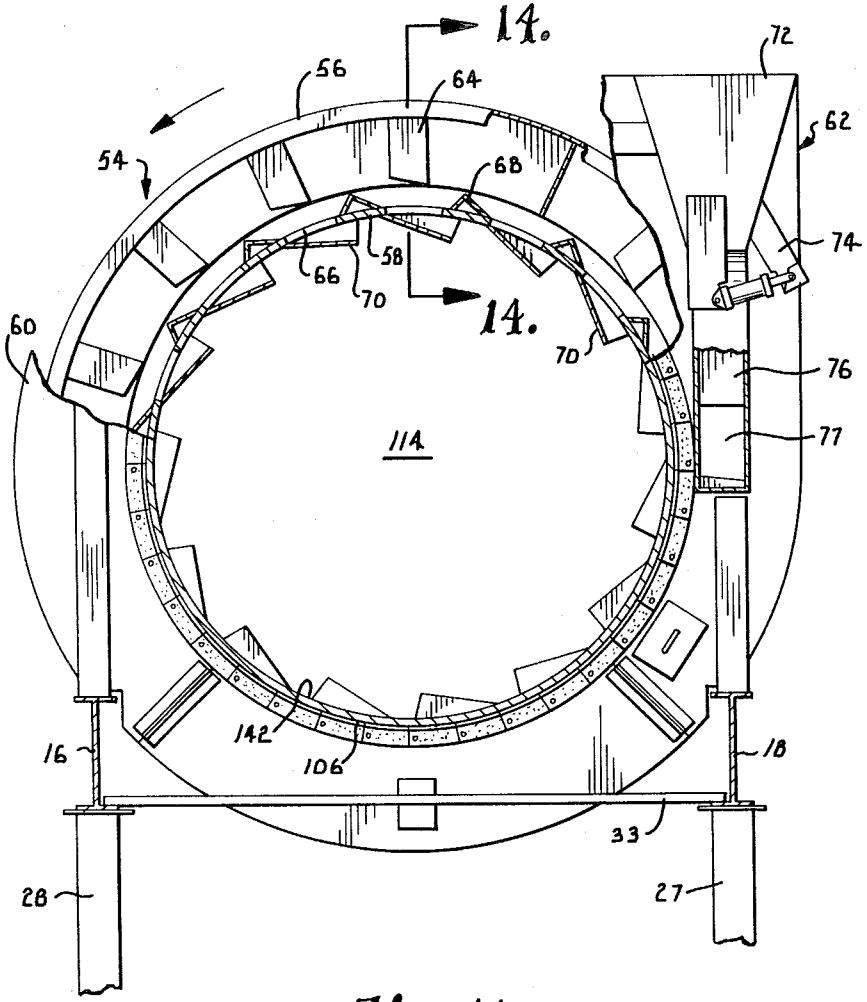
FIG. 11 is an enlarged elevational view taken along line 11—11 of FIG. 1 in the direction of the arrows to illustrate the first recycle feed zone of the drum mixer.
Figure 13:
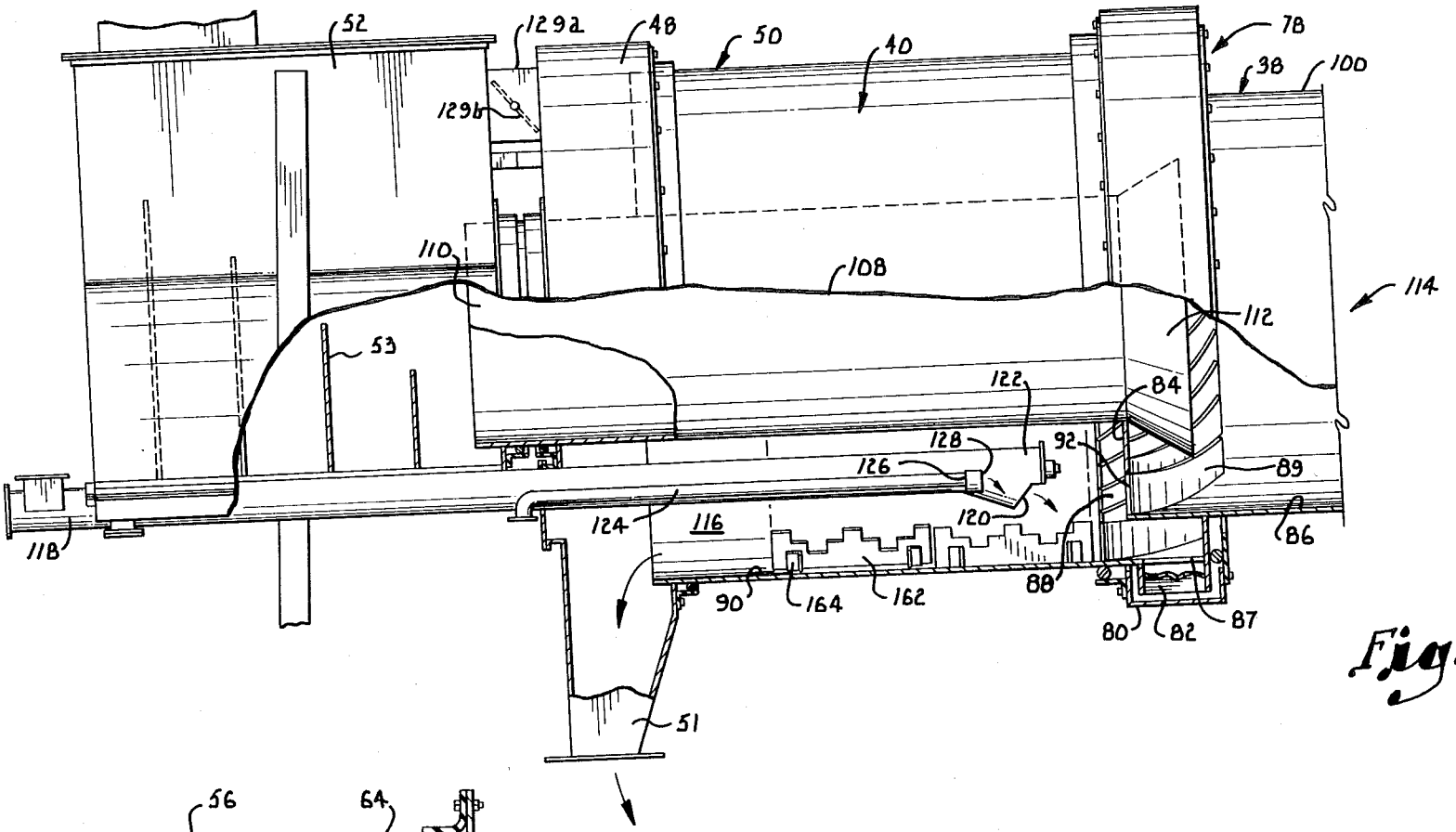
FIG. 13 is an elevational view, partially fragmentary and sectional, of the discharge end of the drum mixer illustrating the exhaust gas ductwork, and the liquid asphalt and mineral fines mixing zone of the drum mixer.
Figure 14:
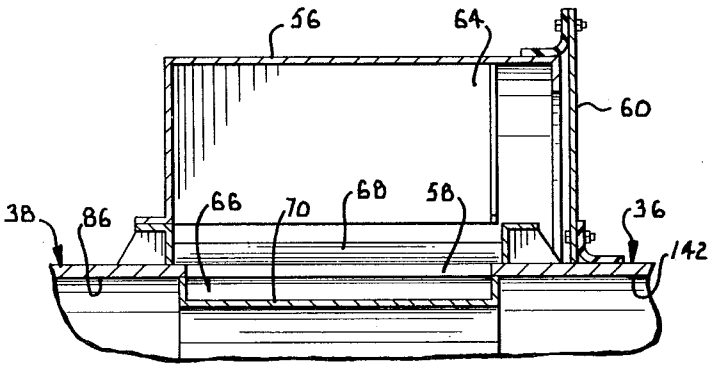
FIG. 14 is an enlarged, fragmentary view taken along line 14—14 of FIG. 11 in the direction of the arrows.

The drum portion 38 contains alternating rows of bucket flighting 140 and J-flighting 152 coupled with the inner surface 86. The J-flighting 152 (FIG. 8) comprises an upright plate 154 having a perpendicular portion 156 and a downwardly and outwardly projecting portion 158. The flighting 152 is mounted to the surface 86 by brackets 160. The flighting is also arranged in sections having offset rows as indicated by the broken lines in FIG. 2.

The flighting coupled with the inner surface 90 of drum portion 40 comprises offset rows of sawtooth flighting 162. The flighting 162 is mounted to surface 90 by brackets 164 and comprises upright plates having irregular step-type upper surfaces. The flighting 162 is arranged in sections as indicated by the broken lines in FIG. 2.

In operation, virgin aggregates are introduced into the passageway 114 by the conveyor 42 as the cylinder 34 is rotated by the rollers 94 and 96. The burner 44 directs a radiant flame within the passageway 114 and a stream of hot gases produced by the flame is drawn through the passageway by an exhaust fan (not shown) coupled with the dust drop out chamber 52. The spiral flighting 132 located at the lip 148 of the cylinder 34 directs the aggregates into the drum portion 35. The aggregates are carried around the inner surface 130 of the drum portion 35 by the T-flighting 134 as the cylinder rotates. The flighting 134 and kicker plates 136 direct the aggregates away from the burner flame projecting into the drum portion 35 to ensure that the flame is not extinguished. Material is exposed to the radiant heat flux of the flame as it is released from the passageway formed between surface 130 and flight element 134*c*. The design of flighting 134 prevents the discharge of material directly through the visible portion of the flame.

The inclined orientation of the cylinder 34 causes the aggregates to move downstream with the kicker flighting 138 directing the aggregates into the drum portion 36. There, the bucket flighting 140 creates a curtain of downwardly cascading aggregates. The stream of hot gases flows through the curtain of aggregates and heats and dries the aggregates. The aggregates are then moved to the collar portion 54 where they may be combined with recycle material. Though the curtain of falling aggregates shields the recycle material from direct contact with the burner flame, the recycle material should preferably be coarsely sized to ensure that the stream of hot gases does not disadvantageously affect the asphalt contained within the recycle material, or to allow significant quantities of small asphalt particles to enter the gas stream and thereby be conveyed into the pollution control equipment located downstream.

The aggregates and recycle material are then mixed by the alternating rows of bucket flighting 140 and J-flighting 152 in drum portion 38. As the mixture reaches the collar portion 78 the spiral flighting 89 directs the mixture through the openings 92 in the plate 84 and into the annular region 116. Recycle material which is dumped into chamber 81 is picked up by scoops 82 and then falls through openings 87 and into the annular region 116 as the cylinder 34 rotates. The spiral flighting 88 directs the mixture and the newly added recycle material downstream where they are mixed together by the saw-tooth flighting 162.

The stream of hot gases as well as dust picked up from the aggregates are drawn through the exhaust tube 108 and into the dust dropout chamber 52. There the baffles 53 knock down the dust from the airstream to reduce the load on the pollution control equipment (not shown) coupled with the chamber 52. The dust drops to the floor of the chamber 52 and may be moved along with mineral fines into the annular region 116 by the screw-type conveyor 118. The dust and mineral fines act as a binder when mixed with the asphalt and aggregates and are directed into the annular region through the opening 120 in the conveyor 118.

Liquid asphalt is directed into the annular region 116 through the opening 128 at the upstream end 126 of the injection tube 124 and is mixed with the aggregates and recycle material. The asphalt is effectively isolated from the flowing stream of hot gases by the exhaust tube 108, thus preventing degradation of the asphalt. Any hydrocarbons driven from the asphalt or recycle material are confined in the annular region and prevented from being drawn through the exhaust tube. Cut-back asphalts can also be safely used in the drum mixer 12 due to the segregation of the annular region 116 from the burner flame and hot gas stream. The asphaltic cement produced from the mixing of the asphalt and aggregates may then be removed through discharge chute 51 which is located in the discharge housing 48.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described my invention, I claim:

1. A drum mixer for producing an asphaltic composition from asphalt and aggregates, said mixer comprising:

a rotatable cylinder having first and second open ends with an internal passageway communicating therebetween and having first and second zones, said cylinder disposed substantially horizontal with said first end inclined slightly above said second end;

drive means to rotate said cylinder about the central longitudinal axis thereof;

aggregate feed means having a discharge portion extending within said first open end of said cylinder to deliver aggregate material to said first zone of said cylinder;

burner means adjacent said first end of said cylinder to generate a hot gas stream within said first zone of said cylinder in order to heat and dry the aggregate material delivered thereto;

an exhaust tube penetrating the second end of said cylinder and disposed within said internal passageway of said cylinder, said exhaust tube communicating with said first zone to remove said hot gas stream generated by said burner means and thereby prevent said hot gas stream from reaching said second zone;

liquid asphalt feed means disposed within said second zone of said cylinder for delivering liquid asphalt thereto to form an asphaltic composition; and discharge means for directing said asphaltic composition from said second zone of said cylinder.

2. The drum mixer as set forth in claim 1, including recycle feed means to deliver recycle asphalt material directly to said second zone of said cylinder.

3. The drum mixer as set forth in claim 1, including recycle feed means to deliver recycle asphalt material directly to said first zone of said cylinder.

4. The drum mixer as set forth in claim 1, including first recycle feed means to deliver recycle asphalt material directly to said first zone of said cylinder; and second recycle feed means to deliver recycle asphalt material directly to said second zone of said cylinder.

5. The drum mixer as set forth in claim 1, wherein said cylinder has a plurality of lifting flights mounted on the interior surface thereof in at least a portion of said first zone for forming a curtain of falling aggregates in the passageway when the cylinder rotates, wherein said hot gas stream flows through the curtain of falling aggregates to heat and dry the aggregates.

6. The drum mixer as set forth in claim 1, wherein said cylinder has a plurality of rigid mixing paddles mounted on the interior surface thereof in at least a portion of said second zone to mix and blend the liquid asphalt with the aggregate to form the asphaltic composition within said second zone.

7. The drum mixer as set forth in claim 1, including a perforated partition within the passageway between said first and second zones, wherein said exhaust tube extends centrally through the partition into said first zone and aggregate material flows through perforations in the partition into said second zone.

8. The drum mixer as set forth in claim 1, including auger feed means for introducing fine binder material into said second zone for mixing with the liquid asphalt and aggregate materials.

* * * * *